US005286312A

United States Patent [19]

Shimotsusa et al.

[11] Patent Number: 5,286,312

[45] Date of Patent: Feb. 15, 1994

[54] HIGH-STRENGTH SPRING STEEL

[75] Inventors: Masataka Shimotsusa; Masao Toyama; Sinichi Ohnishi; Takahiko Nagamatsu; Takenori Nakayama, all of Kobe, Japan

[73] Assignee: Kabushiki Kaisha Kobe Seiko Sho, Kobe, Japan

[21] Appl. No.: 955,434

[22] Filed: Oct. 2, 1992

[30] Foreign Application Priority Data

Oct. 2, 1991 [JP] Japan ..... 3-283588
Aug. 31, 1992 [JP] Japan ..... 4-232399

[51] Int. Cl.[5] ..... C22C 38/46; C22C 38/44

[52] U.S. Cl. ..... 148/335; 148/908; 420/109

[58] Field of Search ..... 148/335, 908; 420/109

[56] References Cited

U.S. PATENT DOCUMENTS 4,650,645 3/1987 Konto et al. ..... 420/109
4,795,609 1/1989 Saka et al. ..... 148/908
5,009,843 4/1991 Sugimoto et al. ..... 420/109

FOREIGN PATENT DOCUMENTS 0124348 11/1984 European Pat. Off. .
0265273 4/1988 European Pat. Off. .
0400564 12/1990 European Pat. Off. .
1807992 6/1969 Fed. Rep. of Germany .
242404 9/1969 U.S.S.R. .
1142236 2/1969 United Kingdom .

*Primary Examiner*—Deborah Yee
*Attorney, Agent, or Firm*—Oblon, Spivak, McClelland, Maier & Neustadt

[57] ABSTRACT

Disclosed is a high-strength spring steel containing C, Si, Mn, Ni, Cr, Mo, V and the like within the specified range, wherein the above components satisfy the following equation:

$$550-333[C]-34[Mn]-20[Cr]-17[Ni]-11[Mo] \geqq 300$$

where [C, Mn, Cr, Ni, or Mo] represents wt % of each component, and the average diameter of the non-metallic inclusions of oxides is specified. By use of the above steel, there can be obtained a high-strength spring steel having a tensile strength of 200 kgf/mm$^2$ or more and being excellent in the fatigue characteristic and the sag resistance. Further, in the above steel, each content of C, Si, Ni, and Cr may be added to satisfies the following equation:

$$50[Si]+25[Ni]+40[Cr]-100[C] \geqq 230$$

where [Si, Ni, Cr or C] represents wt % of each component. Thus the corrosion fatigue characteristic is also improved.

15 Claims, 3 Drawing Sheets

HIGH-STRENGTH SPRING STEEL

BACKGROUND OF THE INVENTION

1. Field of the Invention

The present invention relates to a high-strength spring steel used for a valve spring of an internal combustion engine, a suspension spring and the like, and particularly, to a spring steel for manufacturing a high-strength spring having a tensile strength of 200 kgf/mm$^2$ or more, and satisfying the fatigue life and the sag resistance required as spring characteristics, and further enhancing a corrosion resistance for improving the corrosion fatigue.

2. Description of the Prior Art

The chemical compositions of the spring steels are specified in JIS G3565 to 3567, 4801 and the like. By use of the above spring steels, various springs are manufactured in the steps of: drawing the rolled material to a specified wire diameter, oil-tempering the wire, and spring-forming it (cold-working); or drawing the rolled material, heating and spring-forming the wire, and quenching/tempering it (hot-working). Recently, higher strength steels for springs are being studied to meet the demand for automobiles of less weight.

Concretely, there has been demanded a high-strength spring steel having a tensile strength of 200 kgf/mm$^2$ or more, in place of the conventional spring steel having the tensile strength (after quenching/tempering) of approximately 160–180 kgf/mm$^2$. In the conventional spring steel, of course, it is possible to obtain the tensile strength of 200 kgf/mm$^2$ or more by the heat-treatment; however, in this case, there is arisen such a disadvantage as being lack of the fatigue life and the sag resistance required as the spring characteristics.

Further, as is well known, in the spring steel, the corrosion fatigue as one of the spring characteristics tends to be deteriorated with increase in the tensile strength after quenching/tempering. One of the reason why the corrosion fatigue is deteriorated is as follows: namely, there occurs the pitting-corrosion having a depth of approximately 100 μm on the surface of the spring in use, which becomes the stress concentration source as a starting point for generation of the fatigue crack. Also, it is considered that the notch sensitivity is increased linearly with the high-strengthening. Accordingly, there occurs a fear of generating the breakage or the like for a relatively short period. Particularly, when being used as the parts of an automobile operated in such a high corrosive environment as scattering salt on the road as an antifreezing agent in winter, for example, in North America, the springs have the problem of introducing the corrosion fatigue.

SUMMARY OF THE INVENTION

Taking the above into consideration, the present invention has been made, and an object is to provide a spring steel used for a high-strength spring having a tensile strength of 200 kgf/mm$^2$ or more, and being excellent in the resistances against fatigue, sag and corrosion fatigue.

In a preferred mode of the present invention, there is provided a high-strength spring steel containing 0.3–0.5 wt % (hereinafter, referred to as [%]) of C, 1.0–4.0% of Si, 0.2–0.5% of Mn, 0.5–4.0% of Ni, 0.3–5.0% of Cr, 0.1–2.0% of Mo and 0.1–0.5% of V, and further, 0.05–0.5% of Nb and/or 0.1–1.0% of Cu, and still further, 0.01–0.1% of Al and/or 0.1–5.0% of Co, the balance being essentially Fe and inevitable impurities, wherein the above components satisfy the following equation:

$$550-333[C]-34[Mn]-20[Cr]-17[Ni]-11[Mo] \geqq 330$$

where [C, Mn, Cr, Ni, or Mo] represents wt % of each component.

In the above, it is possible to further enhance the fatigue strength and the spring characteristics by cleaning the steel or restricting the contents of the impurities. Namely, within the measured area of 160 mm$^2$ of the above steel, the number of the non-metallic inclusions of oxides is restricted as follows: those with average particle sizes of 50 μm or more are prohibited to be present; and those with average particle sizes of 20 μm or more are allowed by the number of 10 pieces or less. Also, the inevitable impurities are restricted within the ranges of 15ppm or less of oxygen; 100ppm or less of nitrogen; 100ppm or less of phosphorus; and 100ppm or less of sulfur.

Further, for enhancing the corrosion resistance of the above steel, each content of C, Si, Ni, and Cr is preferably adjusted to satisfy the following equation:

$$50[Si]+25[Ni]+40[Cr]-100[C] \geqq 230$$

where [Si, Ni, Cr or C] represents wt % of each component. Thus there can be obtained a high-strength spring steel highly excellent in the corrosion fatigue resistance.

DETAILED DESCRIPTION OF THE PREFERRED EMBODIMENTS

Figure 1:
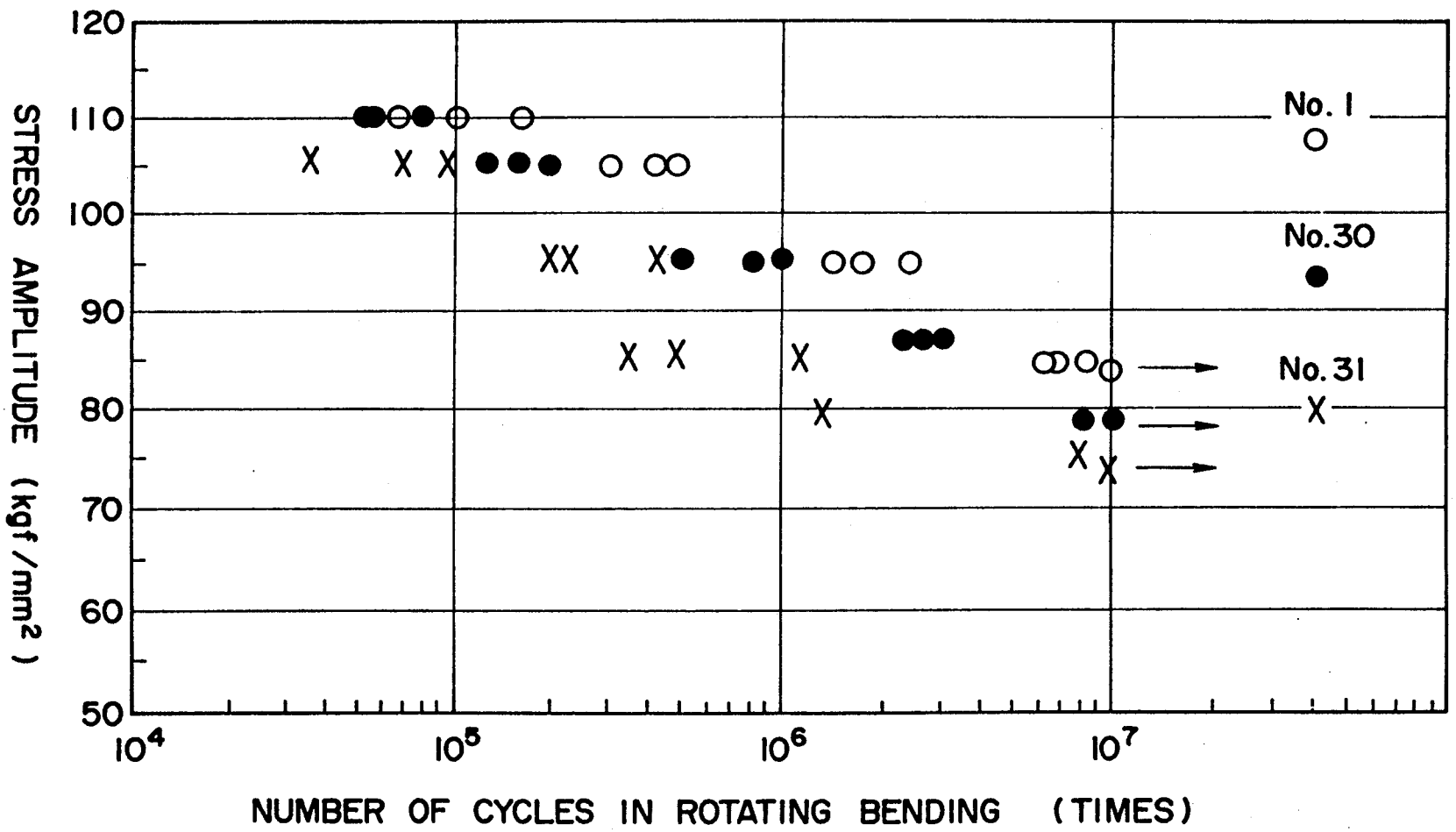
FIG. 1 is a graph showing the results of the rotating bending fatigue test using spring steels in an example.

Prior to description of the preferred embodiments, the function of the present invention will be explained.

In order to high-strengthen the material for enhancing the fatigue life, it is required to improve the toughness of the material. For enhancing the elastic limit, the conventional spring steel contains carbon in a relatively large amount. However, for improving the toughness of the material, it is effective to remarkably reduce the carbon content as compared with the conventional spring steel. However, from the viewpoint of enhancing the tensile strength at a level of 200 kgf/mm$^2$ or more, the reduction of the carbon content without alloying elements brings the lack of the tensile strength after quenching/tempering. Consequently, the reduction of the carbon content, naturally, has a limitation. Also, it is required to add each alloying element within a suitable range.

The present applicants have examined the effect of each alloying element on the tensile strength and the toughness after quenching/tempering while keeping the carbon content within the range of 0.3–0.5% for improving the toughness. As a result, it was revealed that, by adding alloying elements in large amounts respectively while keeping the carbon content within the above range, the tensile strength was conversely lowered. The reason for this is that the retained austenite amount after quenching/tempering is increased linearly with the added amounts of the alloying elements thereby lowering the tensile strength. From such a viewpoint, it becomes apparent that, for securing the tensile strength and the toughness required for the high-strength spring steel, it is necessary to adjust the alloying elements not only to be respectively within the suitable ranges but also at least to satisfy the following equation (1).

$$550-333[C]-34[Mn]-20[Cr]-17[Ni]-11[Mo] \geqq 300 \quad (1)$$

where [C, Mn, Cr, Ni, or Mo] represents wt % of each component.

On the other hand, as described above, in the high-strength steel having a tensile strength of 200 kgf/mm$^2$ or more, the corrosion fatigue is significantly deteriorated. This is because the sensitivity to surface defects is increased linearly with the high-strengthening. Consequently, when the spring made of the above steel is exposed under the corrosive environment, the pitting-corrosion is generated on the surface thereof, which becomes the starting point of the generation of the fatigue cracks thereby causing the breakage and the like. In order to prevent the generation of the above pitting-corrosion on the surface even when the spring is exposed under the corrosive environment, it is necessary to add each alloying element in a suitable amount. Therefore, the steel of the present invention contains each alloying element for improving the pitting corrosion resistance in a suitable amount. Concretely, the present applicants have known the fact that the addition of Cr, Ni, Si and C exerts a large effect on the pitting corrosion resistance. Namely, the pitting corrosion resistance may be significantly improved by adjusting each alloying element to satisfy the following equation (2), thus obtaining the spring steel highly excellent in the corrosion fatigue.

$$50[Si]+25[Ni]+40[Cr]-100[C] \geqq 230 \quad (2)$$

where [Si, Ni, Cr or C] represents wt % of each component.

Further, in the spring steel of the present invention, the fatigue strength is increased by cleaning the steel for reducing the amounts of the non-metallic inclusions as smaller as possible. In particular, it was revealed that the particle sizes of the non-metallic inclusions of oxides exert the large effect on the fatigue characteristics. For example, as the reference thereof, by prohibiting the presence of those with particle sizes of 50 μm or more and allowing those with particle sizes of 20 μm or more by the number of 10 pieces or less within the measured area of 160 mm$^2$, the steel achieved the highly excellent fatigue characteristics. In the above, the average particle size means the average value between the major diameter and the minor diameter of the non-metallic inclusion of oxide. Also, the measured area means the region from the surface layer to the depth of 3 mm in the section of the test steel.

Next, there is explained the reason for limiting the chemical composition in the high-strength spring steel of the present invention.

C: 0.3 to 0.5%

C is an essential element for securing the tensile strength after quenching/tempering. When the C content is less than 0.3%, the hardness of the martensite after quenching is excessively lowered thereby causing the lack of the tensile strength after quenching/tempering. When the C content is in excess of 0.5%, the toughness after quenching/tempering is deteriorated, and further, the desired fatigue characteristic and the corrosion fatigue characteristic cannot be obtained.

Si: 1 to 4%

Si is an essential element for reinforcing the solid solution. When the Si content is less than 1%, the strength of the matrix is insufficient. However, when the Si content is in excess of 4%, the solution of the carbide becomes insufficient upon heating for quenching. Namely, unless the steel is heated at high temperatures upon quenching, the austenitizing doesn't perfectly occur, thereby lowering the tensile strength after quenching/tempering and further deteriorating the sag resistance of the spring. In order to stably obtain the tensile strength of 200 kgf/mm$^2$, the Si content is preferably with the range of 1.5–3.5%.

Mn: 0.2 to 0.5%

Mn is an element of improving the hardenability. To effectively achieve this effect, Mn must be added by 0.2% or more. However, Mn has a nature to enhance the hydrogen permeability against the material after quenching/tempering, and thus to promote the hydrogen embrittlement under the corrosive environment. Accordingly, the Mn content must be restricted within the range of less than 0.5% for preventing the occurrence of the intergranular fracture due to the hydrogen embrittlement for suppressing the lowering of the fatigue life.

Ni: 0.5 to 4.0%

Ni has functions to improve the toughness of the material after quenching/tempering, to enhance the pitting corrosion resistance, and to remarkably improve the sag resistance as an important spring characteristic. To effectively achieve this functions, Ni must be added in an amount of at least 0.5%. However, when the Ni content is in excess of 4%, the Ms point is lowered, and the desired tensile strength cannot be obtained by the effect of the retained austenite. In addition, Ni is an expensive element, and accordingly, is preferably added by 0.5–2.0% in terms of the economy.

Cr: 0.3 to 5.0%

Cr is effective to improve the hardenability in the same as Mn, and to enhance the heat resistance. Further, it is revealed from the various examinations to significantly improve the sag resistance as an important spring characteristic. To effectively achieve these effects, Cr must be added in an amount of 0.3% or more. However, when Cr is excessively added, the toughness after quenching/tempering tends to be lowered. Accordingly, the upper limit of the Cr content is specified at 5%. In order to obtain the excellent strength-ductility balance, the Cr content is preferably within the range of 0.3–3.5%.

Mo: 0.1 to 2.0%

Mo is an element for producing the carbide, and is effective to improve the sag resistance and the fatigue resistance by precipitating the fine carbide upon tempering, thereby promoting the secondary hardening.

When the Mo content is less than 0.1%, the effect is insufficient. However, when the Mo content is in excess of 2.0%, the effect is saturated.

V: 0.1 to 0.5%

V is effective to refine the grain size and thus to enhance the proof stress ratio thereby improving the sag resistance. In order to effectively achieve this effect, V must be added in an amount of 0.1% or more. However, when the V content is in excess of 0.5%, the amount of the carbide not to be dissolved in the austenite phase during the heating for quenching is increased, which remains as the large massive particles thereby lowering the fatigue life.

The high-strength spring steel of the present invention mainly contains the above-described components, and the balance of iron and inevitable impurities. Further, it may contain Nb and/or Cu, and Al and/or Co, as required, for moreover improving the characteristics. The preferable contents of these components are as follows:

Nb 0.05 to 0.5%

Nb is effective to refine the crystal grains and thus to enhance the proof stress ratio for improving the sag resistance in the same as V. To effectively achieve this effect, Nb must be added in an amount of 0.05% or more. However, when the Nb content is in excess of 0.5%, the effect is saturated, or rather, the coarse carbides/nitrides are remained during heating for quenching, thereby deteriorating the fatigue life.

Cu: 0.1 to 1.0%

Cu is such an element as being electrochemically noble more than Fe, and has a function to enhance the pitting corrosion resistance by promoting the general corrosion in the corrosive environment. To effectively achieve this function, Cu must be added in an amount of 0.1% or more. When the Cu content is in excess of 1.0%, the effect is saturated, or rather, there occurs a fear of causing the embrittlement of the material during the hot rolling.

Al: 0.01 to 0.1%

Al is an element of making easy the deoxidation. To effectively achieve, Al must be added in an amount of 0.01% or more. However, when the Al content is in excess of 0.1%, the coarse non metallic inclusions of $Al_2O_3$ are generated thereby lowering the fatigue resistance.

Co: 0.1 to 5.0%

Co is effective to the solid-solution strengthening, to suppress the deterioration of the toughness, and to enhance the corrosion resistance. To effectively achieve these functions, Co must be added in an amount of 0.1% or more, preferably, 1.0% or more. However, Co is an expensive element, and accordingly, the upper limit of the Co content is specified at 5.0%.

Also, O, N, P and S as inevitable impurities forms non-metallic inclusions in the steel and thereby deteriorates the tensile strength, the fatigue characteristic or the hydrogen embrittlement. Accordingly, the contents thereof may be suppressed as smaller as possible. However, in so far as they are restricted within the contents as follows, there substantially occurs no obstruction.

O: 15ppm or less, N: 100ppm or less

O is an element of generating non-metallic inclusions of oxides (in particular, $Al_2O_2$) as starting points of fatigue failure for deteriorating the tensile strength. Accordingly, for high-strengthening, the O content is suppressed within the range of 15ppm or less, preferably, 10ppm or less. Also, N is an element of lowering the ductility and the toughness, and accordingly, is suppressed within the range of 100ppm or less.

P: 100ppm or less, S: 100ppm or less

P is an element of generating the grain boundary segregation and thereby promoting the embrittlement of the material. In particular, it tends to promote the hydrogen embrittlement, and the degree of the risk thereof is linearly increased with the P content. Accordingly, for obtaining the high strength, the P content is preferably suppressed within the range of 100ppm or less. Also, S is an impurity of producing the non-metallic inclusions of MnS thereby promoting the embrittlement of the material. Accordingly, the S content is preferably suppressed within the range of 100ppm or less.

On the other hand, in the manufacturing the high-strength spring, by use of the spring steel having the composition specified in the above-described range and satisfying the above-described equations (1) and (2), it may be quenched and tempered under the condition that the cooling end temperature upon quenching is 50° C. or less. Thus the spring having the desired high-strength and the toughness can be obtained. In general, in quenching the spring, the oil quenching is adopted for preventing the occurrence of the quenching crack. The oil temperature in the quenching is specified at 70–80° C. in consideration of the viscosity of the oil and the like. Accordingly, in the usual oil quenching, it is difficult to reduce the cooling end temperature upon quenching at 50° C. or less. However, using a method of performing the oil cooling at the initial stage of the quenching and the water cooling within the temperature range of 500° C. or less, or a method of adding water-soluble quenching medium in water for preventing the quenching crack, it is possible to achieve the above-described quenching condition.

The present invention will be more clearly understood with reference to the following example. However, the present invention is not limited to the following example, but may be otherwise variously embodied within the scope of the following claims.

EXAMPLE

Steels having the compositions shown as Nos. 1 to 31 in Tables 1 and 2 were melted. Each steel was forged into a square billet of 115mm × 115mm, and was then rolled into a wire rod having a diameter of 11 mm. The wire rod was annealed and was then drawn. After that, the resultant wire was subjected to the oil-quenched/-tempered under the condition that the heating temperature for quenching was 950° C., and the tempering temperature was 400° C. By use of this wire, there were prepared various test steels for tensile test, residual shear strain measurement, rotating bending fatigue test, and corrosion test. These test steels were subjected to the residual shear strain measurement, the rotating bending fatigue test and the corrosion test under the following conditions, respectively:

Residual Shear Strain Measurement

Data of spring
wire diameter: 9.0 mm
coil spring average diameter: 85 mm
total number of turns: 7
effective number of turns: 5.5
free height of spring: 320 m
Setting stress
maximum shear stress: 40 kgf/mm$^2$ Test condition
clamping stress: 130 kgf/mm$^2$
test temperature: 80° C.
test time: 72 hrs.
Calculation method for residual shear strain $$\tau\Delta p = 8D\Delta p/\pi d3 \quad (2)$$

$$\tau \times G\gamma \quad (3)$$

From the equations (2) and (3), $$\gamma\Delta p = \tau\Delta p/G \times 100$$

wherein,
$\tau\Delta p$: torsion stress (kgf/mm$^2$) equivalent to load loss quantity
d: wire diameter (mm)
D: coil average diameter
$\Delta p$: load loss quantity
G: modulus of transverse elasticity (kgf/mm$^2$) (adoption of 8000 kgf/mm$^2$)

Rotating Bending Fatigue Test

Test condition
test temperature: room temperature
surface condition: shot peening finish
Judgement of fatigue limit
testing stress after twice clear of $10^7$ cycles Measurement for Non-metallic Inclusion of Oxide objective material: longitudinal section of rolled material having diameter of 11 mm
measured area: 160 mm$^2$ (3 mm from the surface layer)
measuring apparatus: optical microscope
average particle size: (major diameter +minor diameter)/2

Corrosion Test repeating the leaving as it is in 65% RH at 35° C. for 16 hrs after salt spray for 8 hrs by 14 cycles. measurement for pitting depth: observation for transverse section after heat treatment (optical microscope)

The test results are shown in Tables 3 and 4, together with the values from the equations (1) and (2) and the number of the non-metallic inclusions of oxides having average particles of 20 μm or more within the measured area of 160 mm$^2$.

The examination will be made from Tables 3 and 4 as follows:

(1) When the C content is less than 0.3% (No. 17), the tensile strength is insufficient, that is, being less than 200 kgf/mm$^2$. Meanwhile, when the C content is more than 0.5% (No. 18), the tensile strength is more than kgf/mm$^2$; however, the reduction of area (RA) is remarkably degraded. Also, in each test steel being lack of the added amount of Si, Mn, Ni, Cr or Mo (Nos. 19, 20, 22, 24, 25 or 26), the tensile strength is less than 200 kgf/mm$^2$. Also, as is apparent from the data of No. 28, if each component does not satisfy the equation (1) while being added within the specified range, the quenching is insufficient, and thereby the tensile strength after heat treatment is not sufficiently increased.

(2) From the comparison of the residual shear strain value exhibiting the sag resistance, this example has the excellent sag resistance, because it has the higher strength than the comparative example. Also, as shown in No. 11, when Nb is added in the suitable amount, the residual shear strain is remarkably reduced, and is thus effective to improve the sag resistance.

(3) The rotating bending fatigue characteristic (fatigue limit: kgf/mm$^2$) is significantly affected by the coarse non-metallic inclusions of oxides contained in the steel. Namely, while the fatigue strength is linearly increased with the material strength, in the steel having the high tensile strength of 200 kgf/mm$^2$ or more, the fatigue characteristic is significantly changed depending on the number of the coarse non-metallic inclusions of oxides having average particle sizes of 20 μm or more within the measured area of 160 mm$^2$. When the number is more than 10 (Nos. 17, 18, 22, 23, 24, 25, 26, 27, 30 or 31), the fatigue strength is apparently degraded. Also, the non-metallic inclusions of oxides having particle sizes of 50 μm or more are easily made to be the starting points of the fatigue fructure thereby significantly deteriorating the fatigue characteristic.

Figure 2:
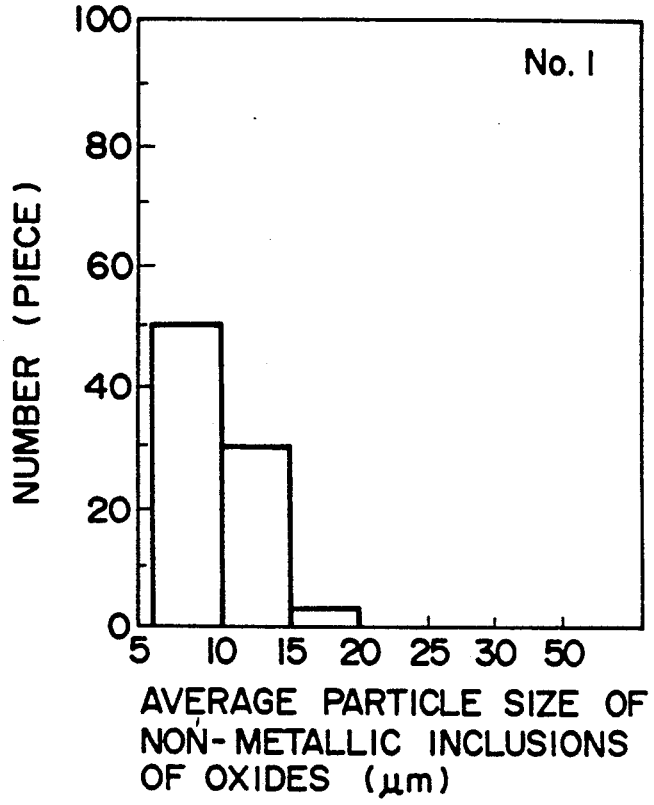
FIG. 2 is a graph showing the average particle sizes of non-metallic inclusions of oxides contained in a test steel No. 1 and the distribution thereof.
Figure 3:
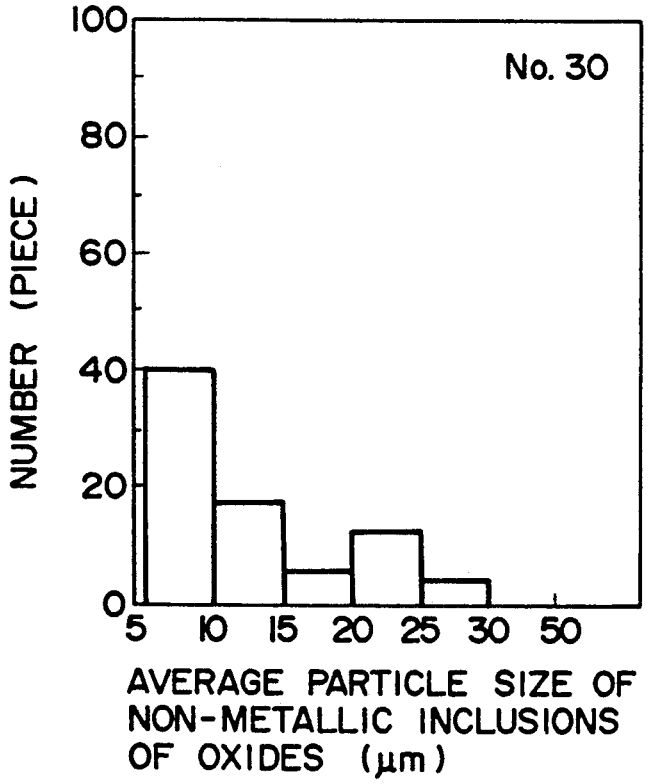
FIG. 3 is a graph showing the average particle sizes of non-metallic inclusions of oxides contained in a test steel No. 30 and the distribution thereof.
Figure 4:
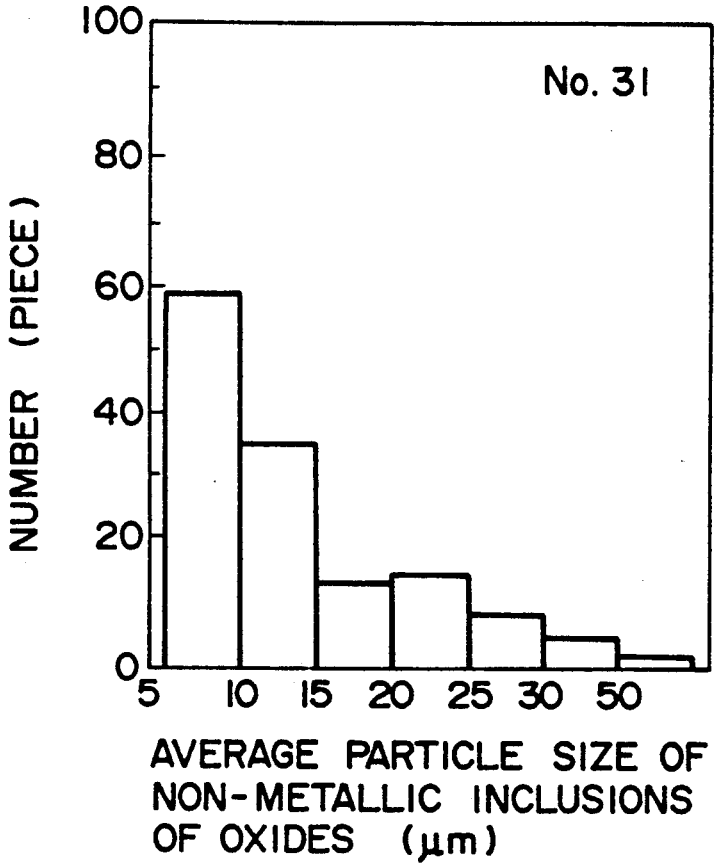
FIG. 4 is a graph showing the average particle sizes of non-metallic inclusions of oxides contained in a test steel No. 31 and the distribution thereof.

In addition, FIG. 1 is a graph showing the rotating bending fatigue test regarding the test steel No. 1 in this example, and the test steels Nos. 30 and 31 in the comparative example (changed in the number of the non-metallic inclusions of oxides having the average sizes of 20 μm or more). FIGS. 2 and 3 are graphs showing the average particle sizes of the non-metallic inclusions of oxides of the test steels Nos. 1, 30 and 31 and the distribution thereof. From these figures, it is revealed that the coarse non-metallic inclusions of oxides exert the adverse effect on the fatigue characteristic.

(4) In the corrosion test, the test steels (Nos. 2, 9, 12, 13, 14, 15 and 16) in this example satisfying the requirement of the equation (2) is significantly reduced in the pitting-corrosion depth and is excellent in the corrosion resistance as compared with the test steels (Nos. 18 and 20) in the comparative example. In the test steel No. 17, Cu is added in the steel equivalent to the test steel No. 1 in a suitable amount, and is reduced in the pitting-corrosion depth thereby improving the corrosion resistance.

TABLE 1

| No | Kind of steel | C | Si | Mn | Ni | Cr | Mo | V | Co | Cu | O | N | P | S | Others |
|---|---|---|---|---|---|---|---|---|---|---|---|---|---|---|---|
| 1 | Example | 0.40 | 2.40 | 0.44 | 1.85 | 0.80 | 0.48 | 0.18 | — | — | 0.0006 | 0.0055 | 0.007 | 0.008 | — |
| 2 | Example | 0.35 | 2.70 | 0.41 | 2.00 | 2.00 | 0.40 | 0.18 | — | — | 0.0008 | 0.0060 | 0.006 | 0.009 | — |
| 3 | Example | 0.47 | 2.40 | 0.40 | 2.10 | 0.90 | 0.35 | 0.20 | — | — | 0.0006 | 0.0049 | 0.007 | 0.007 | — |
| 4 | Example | 0.40 | 3.50 | 0.43 | 1.80 | 0.95 | 0.40 | 0.20 | — | — | 0.0009 | 0.0071 | 0.008 | 0.009 | — |
| 5 | Example | 0.40 | 1.50 | 0.43 | 1.80 | 2.30 | 0.40 | 0.19 | — | — | 0.0010 | 0.0052 | 0.006 | 0.005 | — |
| 6 | Example | 0.40 | 2.40 | 0.40 | 0.50 | 1.50 | 0.40 | 0.18 | — | — | 0.0006 | 0.0057 | 0.006 | 0.008 | — |
| 7 | Example | 0.40 | 2.40 | 0.41 | 2.40 | 0.85 | 0.30 | 0.21 | — | 0.30 | 0.0006 | 0.0047 | 0.008 | 0.006 | — |
| 8 | Example | 0.40 | 2.40 | 0.40 | 2.10 | 0.85 | 0.40 | 0.19 | 1.00 | — | 0.0007 | 0.0062 | 0.005 | 0.006 | — |
| 9 | Example | 0.40 | 2.40 | 0.45 | 2.50 | 2.60 | 0.90 | 0.19 | 2.50 | — | 0.0008 | 0.0051 | 0.008 | 0.007 | — |
| 10 | Example | 0.40 | 2.40 | 0.40 | 1.80 | 0.80 | 0.35 | 0.19 | — | — | 0.0009 | 0.0048 | 0.009 | 0.006 | Al:0.03 |
| 11 | Example | 0.40 | 2.40 | 0.40 | 1.80 | 0.80 | 0.35 | 0.19 | — | — | 0.0007 | 0.0053 | 0.006 | 0.007 | Nb:0.05 |
| 12 | Example | 0.35 | 2.50 | 0.40 | 1.00 | 3.00 | 0.20 | 0.20 | — | — | 0.0006 | 0.0064 | 0.008 | 0.009 | — |

TABLE 1-continued

| No | Kind of steel | C | Si | Mn | Ni | Cr | Mo | V | Co | Cu | O | N | P | S | Others |
|---|---|---|---|---|---|---|---|---|---|---|---|---|---|---|---|
| 13 | Example | 0.33 | 3.00 | 0.41 | 1.80 | 3.00 | 0.45 | 0.20 | — | — | 0.0006 | 0.0070 | 0.006 | 0.007 | — |
| 14 | Example | 0.34 | 3.05 | 0.42 | 0.60 | 3.80 | 0.41 | 0.19 | — | — | 0.0007 | 0.0072 | 0.006 | 0.005 | — |
| 15 | Example | 0.35 | 2.75 | 0.45 | 1.87 | 3.10 | 0.44 | 0.21 | — | — | 0.0005 | 0.0056 | 0.008 | 0.009 | — |
| 16 | Example | 0.35 | 2.50 | 0.40 | 1.00 | 3.00 | 0.20 | 0.20 | 3.00 | — | 0.0009 | 0.0049 | 0.005 | 0.007 | — |

TABLE 2

| No | Kind of steel | C | Si | Mn | Ni | Cr | Mo | V | Co | Cu | O | N | P | S | Others |
|---|---|---|---|---|---|---|---|---|---|---|---|---|---|---|---|
| 17 | Comp. example | 0.28 | 2.20 | 0.20 | 0.50 | 1.00 | 0.20 | 0.18 | — | — | 0.0012 | 0.0066 | 0.008 | 0.009 | — |
| 18 | Comp. example | 0.55 | 2.20 | 0.20 | 1.50 | 1.20 | 0.30 | 0.18 | — | — | 0.0010 | 0.0070 | 0.010 | 0.009 | — |
| 19 | Comp. example | 0.41 | 2.30 | 0.40 | — | 0.80 | 0.40 | 0.20 | — | — | 0.0009 | 0.0061 | — | — | — |
| 20 | Comp. example | 0.40 | 0.80 | 0.80 | 1.50 | 1.30 | 0.40 | 0.19 | — | — | 0.0009 | 0.0066 | 0.008 | 0.009 | — |
| 21 | Comp. example | 0.40 | 2.30 | 0.80 | 1.50 | 1.30 | 0.30 | 0.18 | — | — | 0.0007 | 0.0059 | 0.009 | 0.009 | — |
| 22 | Comp. example | 0.41 | 2.30 | 0.10 | 1.50 | 1.30 | 0.30 | 0.18 | — | — | 0.0006 | 0.0057 | 0.007 | 0.006 | — |
| 23 | Comp. example | 0.42 | 2.25 | 0.43 | 4.50 | 0.90 | 0.30 | 0.18 | — | — | 0.0009 | 0.0063 | 0.008 | 0.007 | — |
| 24 | Comp. example | 0.41 | 2.40 | 0.40 | 1.80 | 0.10 | 0.30 | 0.19 | — | — | 0.0013 | 0.0061 | 0.006 | 0.005 | — |
| 25 | Comp. example | 0.38 | 2.20 | 0.39 | 2.00 | 1.00 | 0.00 | 0.22 | — | — | 0.0012 | 0.0055 | 0.008 | 0.005 | — |
| 26 | Comp. example | 0.40 | 2.20 | 0.42 | 2.10 | 0.20 | 2.30 | 0.19 | — | — | 0.0014 | 0.0048 | 0.005 | 0.008 | — |
| 27 | Comp. example | 0.40 | 2.38 | 0.41 | 1.87 | 0.75 | 0.51 | 0.21 | — | — | 0.0011 | 0.0056 | 0.010 | 0.012 | — |
| 28 | Comp. example | 0.48 | 2.40 | 0.45 | 2.50 | 2.60 | 0.90 | 0.19 | — | — | 0.0012 | 0.0059 | 0.008 | 0.009 | — |
| 29 | Comp. example | 0.40 | 2.40 | 0.44 | 1.85 | 0.80 | 0.48 | 0.18 | — | — | 0.0014 | 0.0052 | 0.025 | 0.015 | — |
| 30 | Comp. example | 0.40 | 2.40 | 0.44 | 1.85 | 0.80 | 0.48 | 0.18 | — | — | 0.0019 | 0.0153 | 0.012 | 0.015 | — |
| 31 | Comp. example | 0.40 | 2.40 | 0.44 | 1.85 | 0.80 | 0.48 | 0.18 | — | — | 0.0023 | 0.0067 | 0.011 | 0.013 | — |

TABLE 3

| No | Kind of steel | Equation (1) | Equation (2) | Number of inclusions ≧20 μm | RA % | TS kgf/mm² | Residual shearing strain | Fatigue limit kgf/mm² | Pitting depth μm |
|---|---|---|---|---|---|---|---|---|---|
| 1 | Example | 349.9 | 158.2 | 0 | 43 | 211 | $9.8 \times 10^{-4}$ | 84.0 | 144 |
| 2 | Example | 341.1 | 230.0 | 1 | 45 | 203 | $9.9 \times 10^{-4}$ | 82.0 | .87 |
| 3 | Example | 322.3 | 161.5 | 0 | 38 | 213 | $7.2 \times 10^{-4}$ | 86.0 | — |
| 4 | Example | 348.1 | 218.0 | 5 | 40 | 216 | $5.4 \times 10^{-4}$ | 83.0 | — |
| 5 | Example | 321.1 | 172.0 | 7 | 43 | 208 | $8.9 \times 10^{-4}$ | 88.0 | — |
| 6 | Example | 360.3 | 152.5 | 0 | 43 | 213 | $9.7 \times 10^{-4}$ | 86.0 | — |
| 7 | Example | 341.7 | 174.0 | 0 | 40 | 213 | $8.4 \times 10^{-4}$ | 85.0 | 125 |
| 8 | Example | 346.1 | 166.5 | 0 | 43 | 213 | $8.6 \times 10^{-4}$ | 85.0 | — |
| 9 | Example | 352.7 | 238.5 | 3 | 45 | 216 | $8.2 \times 10^{-4}$ | 88.0 | 82 |
| 10 | Example | 352.7 | 157.0 | 7 | 42 | 214 | $9.1 \times 10^{-4}$ | 86.0 | — |
| 11 | Example | 352.7 | 157.0 | 4 | 40 | 218 | $7.9 \times 10^{-4}$ | 90.0 | — |
| 12 | Example | 340.6 | 235.0 | 1 | 45 | 203 | $10.5 \times 10^{-4}$ | 87.0 | 86 |
| 13 | Example | 330.6 | 282.0 | 0 | 43 | 207 | $9.5 \times 10^{-4}$ | 88.0 | 65 |
| 14 | Example | 330.4 | 287.5 | 0 | 40 | 213 | $7.8 \times 10^{-4}$ | 88.0 | 62 |
| 15 | Example | 319.5 | 273.2 | 0 | 42 | 208 | $8.7 \times 10^{-4}$ | 86.0 | 73 |
| 16 | Example | 338.8 | 235.0 | 4 | 39 | 216 | $9.4 \times 10^{-4}$ | 89.0 | 69 |

TABLE 4

| No | Kind of steel | Equation (1) | Equation (2) | Number of inclusions ≧20 μm | RA % | TS kgf/mm² | Residual shearing strain | Fatique limit kgf/mm² | Pitting depth μm |
|---|---|---|---|---|---|---|---|---|---|
| 17 | Comp. example | 405.9 | 130.5 | 12 | 45 | 185 | $22.4 \times 10^{-4}$ | 75.0 | — |
| 18 | Comp. example | 307.2 | 140.5 | 13 | 28 | 203 | $10.7 \times 10^{-4}$ | 81.0 | 157 |
| 19 | Comp. example | 379.4 | 106.0 | 11 | 43 | 198 | $17.0 \times 10^{-4}$ | 78.0 | — |
| 20 | Comp. example | 333.7 | 89.5 | 7 | 42 | 195 | $17.6 \times 10^{-4}$ | 78.0 | 189 |

TABLE 4-continued

| No | Kind of steel | Equation (1) | Equation (2) | Number of inclusions ≧20 μm | RA % | TS kgf/mm² | Residual shearing strain | Fatique limit kgf/mm² | Pitting depth μm |
|---|---|---|---|---|---|---|---|---|---|
| 21 | Comp. example | 334.8 | 164.5 | 8 | 40 | 205 | $11.3 \times 10^{-4}$ | 84.0 | — |
| 22 | Comp. example | 355.2 | 163.5 | 0 | 38 | 190 | $18.1 \times 10^{-4}$ | 75.0 | — |
| 23 | Comp. example | 297.7 | 219.0 | 4 | 41 | 193 | $12.3 \times 10^{-4}$ | 76.0 | — |
| 24 | Comp. example | 363.9 | 128.0 | 18 | 37 | 190 | $19.8 \times 10^{-4}$ | 77.0 | — |
| 25 | Comp. example | 356.2 | 162.0 | 15 | 38 | 195 | $17.4 \times 10^{-4}$ | 79.0 | — |
| 26 | Comp. example | 317.5 | 170.5 | 16 | 28 | 190 | $8.8 \times 10^{-4}$ | 76.0 | — |
| 27 | Comp. example | 350.5 | 155.8 | 17 | 40 | 212 | $10.2 \times 10^{-4}$ | 78.0 | — |
| 28 | Comp. example | 270.4 | 238.5 | 12 | 31 | 193 | $7.1 \times 10^{-4}$ | 77.0 | — |
| 29 | Comp. example | 349.9 | 158.2 | 8 | 24 | 214 | — | 82.0 | — |
| 30 | Comp. example | 349.9 | 158.2 | 18 | 32 | 217 | — | 78.0 | — |
| 31 | Comp. example | 329.9 | 158.2 | 29 | 38 | 213 | — | 73.0 | — |

What is claimed is:

1. A high-strength spring steel which comprises:
0.3–0.5 wt. % C
1.0–4.0 wt. % Si
0.2–0.5 wt. % Mn
0.5–4.0 wt. % Ni
0.3–5.0 wt. % Cr
0.1–2.0 wt. % Mo
0.1–0.5 wt. % V
the balance being essentially Fe and inevitable impurities,
wherein the above components satisfy the following equation:

$$550-330(C)-34(Mn)-20(Cr)-17(Ni)-11(Mo) \geqq 300$$

wherein (c), (Mn) (Cr), (Ni), and (Mo) represent wt. % of each element; and
non-metallic inclusions of oxides with average particles sizes of 50 micrometers or more are not present, and those inclusions with an average particle size of 20 micrometers or more may be present in an amount of 10 inclusions or less per 160 mm².

2. A high-strength spring steel comprising:
0.3–0.5 wt. % C
1.0–4.0 wt. % Si
0.2–0.5 wt. % Mn
0.5–4.0 wt. % Ni
0.3–5.0 wt. % Cr
0.1–2.0 wt. % Mo and
0.1–0.5 wt. % V
and further comprising at least one element selected from the group consisting of 0.05–0.5 wt. % Nb and 0.1–1.0 wt. % Cu; the balance being essentially Fe and inevitable impurities,
wherein the above components satisfy the following equation:

$$550-330(C)-34(Mn)-20(Cr)-17(Ni)-11(Mo) \geqq 330$$

wherein (C), (Mn), (Cr), (Ni), and (Mo) represent weight percent of each element.

3. A high-strength spring steel according to claim 2, further comprising at least one element selected from the group consisting of 0.01–0.1 wt % of Al and 0.1–5 wt % of Co.

4. A high-strength spring steel according to claim 3 or 2, wherein the non-metallic inclusions of oxides with average particle sizes of 50 μm or more may not be present, and in those inclusions with average particles sizes of 20 μm or more may be present in an amount of 10 inclusions or less per 160 mm².

5. A high-strength spring steel according to any one of claims 3 or 2, wherein the inevitable impurities are restricted within the ranges of 15ppm or less of oxygen, 100ppm or less of nitrogen, 100ppm or less of phosphorus, and 100ppm or less of sulfur.

6. A high-strength spring steel according to claim 1, wherein the content of C, Si, Ni, and Cr satisfies the following equation, thereby improving the corrosion resistance:

$$50(Si)+25(Ni)+40(Cr)-100(C) \geqq 230$$

wherein (Si), (Ni), (Cr) and (C) represent wt. % of each element.

7. A high-strength spring steel according to claim 6, wherein the inevitable impurities are restricted within the ranges of 15ppm or less of oxygen, 100ppm or less of nitrogen, 100ppm or less of phosphorus, and 100ppm or less of sulfur.

8. A high-strength spring steel according to any one of claims 3, or 2, wherein the content of C, Si, Ni, and Cr satisfies the following equation for improving the corrosion resistance:

$$50(Si)+25(Ni)+40(Cr)-100(C) \geqq 230$$

wherein (Si), (Ni), (Cr), or (C) represent wt. % of each element.

9. A high-strength spring steel according to either claim 1 or 2, wherein the high-strength spring steel has a tensile strength of 200 kgf/mm² or more.

10. A high-strength spring-steel according to claim 3, wherein the inevitable impurities are restricted within the range of 15 ppm or less of oxygen, 100 ppm or less of nitrogen, 100 ppm or less of phosphorus, and 100 ppm or less of sulfur, and wherein the non-metallic inclusions of oxides with average particle sizes of 50 μm or more may not be present, and in those inclusions with average particles sizes of 20 μm or more may be present in an amount of 10 inclusions or less per 160 $mm^2$.

11. A high-strength spring-steel according to claim 1, wherein the inevitable impurites are restricted within the ranges of 15 ppm or less of oxygen, 100 ppm or less of nitrogen, 100 ppm or less of phosphorus, and 100 ppm or less of sulfur, and wherein the non-metallic inclusions of oxides with average particle sizes of 50 μm or more may not be present, and in those inclusions with average particles sizes of 20 μm or more may be present in an amount of 10 inclusions or less per 160 $mm^2$.

12. A high-strength spring-steel according to claim 2, wherein the inevitable impurities are restricted within the ranges of 15 ppm or less of oxygen, 100 ppm or less of nitrogen, 100 ppm or less of phosphorus, and 100 ppm or less of sulfur, and wherein the non-metallic inclusions of oxides with average particle sizes of 50 μm or more may not be present, and in those inclusions with average particles sizes of 20 μm or more may be present in an amount of 10 inclusions or less per 160 $mm^2$.

13. A high-strength spring steel according to claim 2, wherein the content of C, Si, Ni, and Cr satisfies the following equation for improving the corrosion resistance:

$$50(Si)+25(Ni)+40(Cr)-100(C) \geqq 230$$

wherein (Si), (Ni), (Cr), or (C) represent wt. % of each element, wherein the non-metallic inclusions of oxides with average particle sizes of 50 μm or more may not be present, and in those inclusions with average particles sizes of 20 μm or more may be present in an amount of 10 inclusions or less per 160 $mm^2$.

14. A high-strength spring steel according to claim 3, wherein the content of C, Si, Ni, and Cr satisfies the following equation for improving the corrosion resistance:

$$50(Si)+25(Ni)+40(Cr)-100(C) \geqq 230$$

wherein (Si), (Ni), (Cr), or (C) represent wt. % of each element, wherein the non-metallic inclusions of oxides with average particle sizes of 50 μm or more may not be present, and in those inclusions with average particles sizes of 20 μm or more may be present in an amount of 10 inclusions or less per 160 $mm^2$.

15. A high-strength spring steel according to claim 2, wherein the inevitable impurities are restricted within the ranges of 11 ppm or less of oxygen, 100 ppm or less of nitrogen, 100 ppm or less of phosphorus, and 100 ppm or less of sulfur; and wherein the content of C, Si, Ni, and Cr satisfies the following equation for improving the corrosion resistance:

$$50(si)+25(Ni)+40(Cr)-100(C) \geqq 230$$

wherein (Si), (Ni), (Cr), or (C) represent wt. % of each element.

* * * * *